US007990326B2

(12) United States Patent
Nakamura et al.

(10) Patent No.: US 7,990,326 B2
(45) Date of Patent: Aug. 2, 2011

(54) ANTENNA APPARATUS AND ADJUSTING METHOD THEREOF

(75) Inventors: Kouichi Nakamura, Miyazaki (JP); Kuniaki Kiyosue, Miyazaki (JP); Kenji Taniguchi, Miyazaki (JP); Naoyuki Kobayashi, Miyazaki (JP)

(73) Assignee: Panasonic Corporation, Osaka (JP)

( * ) Notice: Subject to any disclaimer, the term of this patent is extended or adjusted under 35 U.S.C. 154(b) by 324 days.

(21) Appl. No.: 12/349,536

(22) Filed: Jan. 7, 2009

(65) Prior Publication Data

US 2009/0179812 A1 Jul. 16, 2009

(30) Foreign Application Priority Data

Jan. 8, 2008 (JP) ..... P2008-000911

(51) Int. Cl.
*H01Q 11/12* (2006.01)

(52) U.S. Cl. ..... 343/742; 343/767; 343/788; 343/895

(58) Field of Classification Search ..... 343/728, 343/742, 787, 788, 866, 867, 895
See application file for complete search history.

(56) References Cited

U.S. PATENT DOCUMENTS

| | | | | |
|---|---|---|---|---|
| 4,922,261 | A * | 5/1990 | O'Farrell | 343/742 |
| 6,243,045 | B1 * | 6/2001 | Ishibashi | 343/741 |
| 7,432,723 | B2 * | 10/2008 | Ellis et al. | 324/654 |
| 2003/0186725 | A1 | 10/2003 | Miya et al. | |
| 2007/0183515 | A1 | 8/2007 | Lim et al. | |
| 2008/0150693 | A1 * | 6/2008 | You et al. | 340/10.1 |
| 2009/0027285 | A1 | 1/2009 | Deguchi | |

FOREIGN PATENT DOCUMENTS

| | | |
|---|---|---|
| JP | 2001-10264 | 1/2001 |
| JP | 2006-287659 | 10/2006 |

OTHER PUBLICATIONS

English language Abstract of JP 2001-10264, Jan. 1, 2001.
English language Abstract of JP 2006-287659, Oct. 19, 2006.

* cited by examiner

*Primary Examiner* — Tan Ho
(74) *Attorney, Agent, or Firm* — Greenblum & Bernstein, P.L.C.

(57) ABSTRACT

An antenna apparatus includes a base member that has an antenna unit and a loop pattern. The loop pattern is wound in such a manner that a magnetic field of the loop pattern is generated along the same direction as that of the antenna unit. Additionally, the loop pattern is formed by a plurality of loops connected parallel to each other.

9 Claims, 6 Drawing Sheets

ANTENNA APPARATUS AND ADJUSTING METHOD THEREOF

BACKGROUND

1. Field of the Invention

The present invention generally relates to an antenna apparatus which is employed in a wireless communication medium processing apparatus communicated with a wireless communication medium such as an RFID (Radio Frequency Identification), namely, an IC card, an IC tag, and the like, or which is employed in the wireless communication medium itself. More specifically, the present invention is directed to such an antenna apparatus which can be made thin and in low cost and can improve a communication characteristic thereof in a microwave system, and an electromagnetic induction system, and also, is directed to an adjusting method thereof.

2. Description of the Related Art

Conventionally, in an RFID medium, namely, a non-contact type IC card, or an IC tag, in such a case that an antenna characteristic thereof is adjusted, as represented in FIG. 10, the following adjusting operation has been performed. That is, a capacitor pattern 102 and an adjusting-purpose resistance pattern 103 have been formed within an antenna unit 105, and then, a resonant frequency of an antenna apparatus 101 and a Q value thereof have been adjusted by trimming, or etching these patterns 102 and 103 (refer to, for example, patent publication 1).

Patent Publication 1: JP-A-2001-10264

Patent Publication 2: JP-A-2006-287659

However, in the above-described adjusting method, the magnetic field of the adjusting-purpose resistance pattern 103 are not coincident with the same direction as the magnetic field of the antenna unit 105, but are exerted in such a manner that these magnetic fields are partially canceled with each other. As a result, the adjusting range of the resonant frequency of the antenna apparatus 101 becomes narrow. Also, in such a case that the resonant frequency of the antenna apparatus 101 is adjusted by the capacitor pattern 102, the below-mentioned problem occurs. That is, under high temperature and high humidity environments, a dielectric constant of a base material 104 is changed, so that the resonant frequency of the antenna apparatus 101 is changed.

In order to secure communication stabilities as to wireless communication processing apparatuses that establish communications with various sorts of wireless communication media and in the wireless communication media themselves, resonant frequencies of antenna apparatuses are required to be made coincident with desirable frequencies (for example, 13.56 MHz).

However, in the conventional antenna apparatuses, since the adjusting ranges of the resonant frequencies in the antenna patterns have been made narrow, the resonant frequencies could not be adjusted when these antenna apparatuses were assembled. As a result, a large number of inferior antenna apparatuses have been manufactured.

Also, while loop-shaped antenna patterns have been formed in such a manner that magnetic fields thereof are produced along the same direction to that of the loop-shaped antenna patterns, resonant frequencies of the antennas have been adjusted by changing turn numbers of the loops (refer to, for instance, patent publication 2).

However, since the resonant frequencies have been adjusted by changing the turn numbers, the resonant frequencies could not be adjusted during assembling of the antenna apparatuses.

Further, tolerance ranges of center frequencies in antenna apparatuses, which are required from manufacturers of a portable telephone have been narrowed year by year, and therefore, adjusting of resonant frequencies of the antenna apparatuses could be very hardly carried out.

SUMMARY

The present invention has been made to solve the above-described problems, and therefore, has an object to provide such an antenna apparatus capable of expanding an adjusting range of a resonant frequency thereof, and also, capable of realizing a narrow tolerance with respect to a center frequency of an antenna thereof which has been required by manufacturers of portable telephones with respect to antenna apparatuses which perform communication operations by employing an electromagnetic induction system, or a microwave system.

To solve the above-described problems, an antenna apparatus, according to the present invention, is featured by comprising: a first loop pattern and a second loop pattern, which are provided within an antenna board, and the second loop pattern is wound in such that a magnetic field is generated from the second loop pattern along the same direction as that of the first loop antenna; in which the second loop pattern is formed by a plurality of loops connected parallel to each other.

In accordance with the present invention, since the second loop pattern is wound in such a manner that the magnetic field is generated from the second loop pattern along the same direction as that of the first loop pattern, the magnetic field generated by the second loop pattern is not canceled by the magnetic field generated from the first loop pattern. As a result, the second loop pattern is cut off, so that the adjusting range of the resonant frequency of the antenna apparatus can be largely expanded, and therefore, occurrences of the adjustment failures of the resonant frequency when the antenna apparatus is assembled can be greatly lowered.

DETAILED DESCRIPTION

Referring now to drawings, a description is made of embodiments of the present invention.

Embodiment 1

Firstly, a description is made of a shape and a structure of an antenna apparatus 1 according to an embodiment 1 of the present invention.

Figure 1:
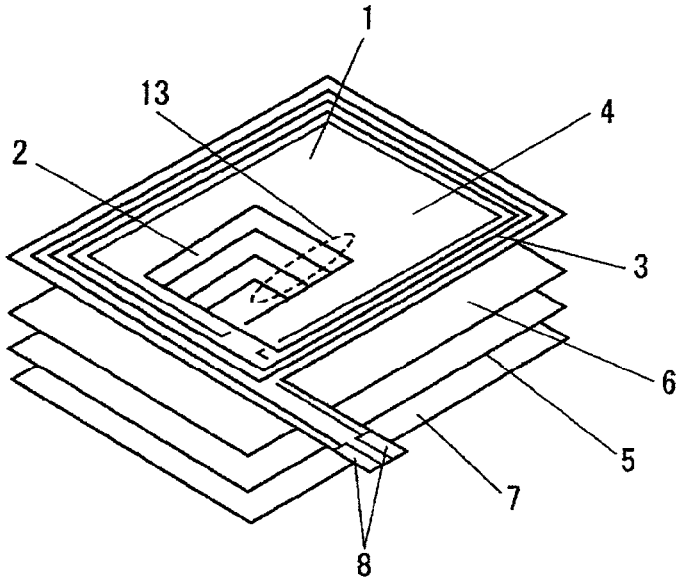
FIG. 1 is a perspective view for showing an antenna apparatus according to an embodiment 1 of the present invention.

The antenna apparatus 1 indicated in FIG. 1 has been constructed in such manner that an antenna unit 3 corresponding to a first loop pattern has been formed on a base member 4, and a loop pattern 2 corresponding to a second loop pattern has been formed in a portion of the antenna unit 3. A magnetic seat 5 coated by protection members 6 and 7 has been adhered to an under portion of the base member 4.

It should also be noted that both the loop pattern 2 and the antenna unit 3 have been wound along a clockwise direction in such a manner that antenna currents may flow along the same direction. As a result, magnetic fields are generated from the loop pattern 2 and the antenna unit 3 along the same direction.

As a consequence, since the magnetic field generated from the loop pattern 2 is not canceled by the magnetic field generated from the antenna unit 3, an adjusting range of a resonant frequency of the antenna apparatus 1 can be largely expanded by cutting the second loop pattern 2, and also, adjustment failures of the resonant frequency occurred when the antenna apparatus 1 is assembled can be largely reduced.

Next, a detailed description is made of respective structural members that construct the antenna apparatus 1 with reference to FIG. 1.

Firstly, a description is made of the loop pattern 2.

While the loop pattern 2 has been formed in a portion of the antenna unit 3, loop patterns have been wound by several turns so as to form the above-described loop pattern 2, and the respective loop patterns 2 have been connected to each other from contact points between these loop patterns 2 and the antenna unit 3 in a parallel manner. Then, since the loop pattern 2 has been formed on an upper plane of the antenna apparatus 1, the resonant frequency of the antenna apparatus 1 can be adjusted by trimming the loop antenna 2 even after the antenna apparatus 1 has been assembled.

As materials of the loop pattern 2, any proper materials may be selected from metal wire materials, metal plate materials, metal foil materials, or metal tube materials, which have electric conductive characteristics and are made of gold, silver, copper, aluminum, nickel and the like. The loop pattern 2 may be formed by metal wires, metal foil, electric conductive paste, plating transfer, sputtering, vapor depositions, or screen printing.

Figure 2:
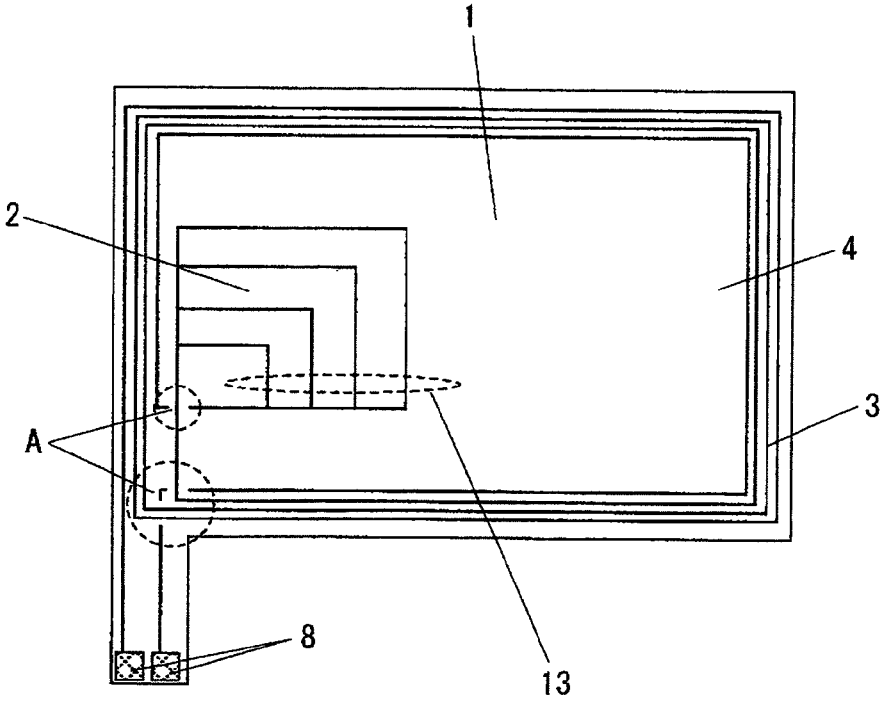
FIG. 2 is an upper view for indicating the antenna apparatus according to the embodiment 1 of the present invention.

Although the loop antenna 2 may be formed even on a center portion, or a side plane of the antenna unit 3, it is preferable to form the loop antenna pattern 2 on the side plane side of the antenna unit 3, as indicated in FIG. 2, while considering such an aspect that magnetic flux generated from a reader/writer (not shown) is not disturbed by this loop pattern 2.

It should be understood that such portions indicated by "A" in FIG. 2 where the loop pattern 2 has been intersected with conductive wires contained in the antenna unit 2 represent that gaps among the intersected wires have been electrically insulated, while these wires become conductive one by one. This condition may be similarly applied to drawings subsequent to FIG. 1.

Figure 3:
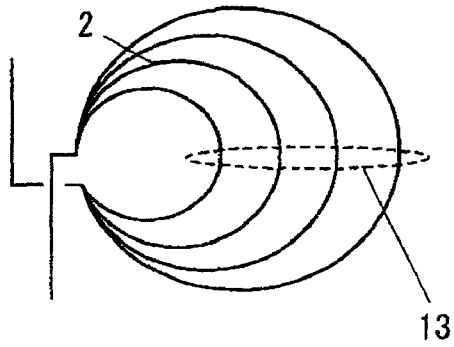
FIG. 3 is a diagram for indicating loop antennas according to the embodiment 1 of the present invention.
Figure 3:
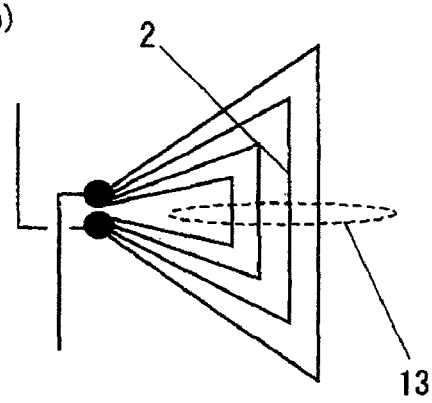

Also, since a dimension of the loop pattern 2 is changed, the adjusting range of the resonant frequency of the antenna apparatus 1 can be changed. In the antenna unit 3 of the antenna apparatus 1 according to the embodiment 1 of the present invention, if a length of one edge of the loop pattern 2 is selected to be shorter than, or equal to 1.5 mm, then a frequency adjustment of the antenna apparatus 1 becomes −20 KHz; if a length of one edge of the loop pattern 2 is selected to be shorter than, or equal to 2.0 mm, then a frequency adjustment of the antenna apparatus 1 becomes −50 KHz; if a length of one edge of the loop pattern 2 is selected to be shorter than, or equal to 5.0 mm, then a frequency adjustment of the antenna apparatus 1 becomes −100 KHz; if a length of one edge of the loop pattern 2 is selected to be shorter than, or equal to 10.0 mm, then a frequency adjustment of the antenna apparatus 1 becomes −500 KHz. Therefore, the adjusting range of the resonant frequency of the antenna apparatus 1 may also be expanded in connection with increasing of one edge length of the loop pattern 2. It should also be noted that as a shape of the loop pattern 2, a rectangular shape, a circular shape, or a polygonal shape. For instance, such shapes as indicated in FIG. 3 may be employed as the shape of this loop pattern 2.

As trimming of the loop antenna 2, a stamping jig, or a trimming by utilizing laser rays may be employed.

Next, a description is made of the antenna unit 3.

The antenna unit 3 corresponds to an antenna pattern, and is formed in a spiral shape. As a structure of the spiral antenna pattern, any sorts of spiral shapes having opening portions at centers thereof may be employed, the shapes of which may be selected from a circular shape, a substantially rectangular shape, or a polygonal shape. Since the antenna unit 3 is made of such a spiral structure, sufficiently strong magnetic fields can be generated, so that wireless communication media can be communicated with wireless communication media processing apparatuses by producing electric induction power and based upon mutual inductances. Alternatively, the antenna unit 3 may be realized by combining a reception-purpose antenna with a transmission-purpose antenna.

As materials of the antenna unit 3, any proper materials may be selected from metal wire materials, metal plate materials, metal foil materials, or metal tube materials, which have electric conductive characteristics and are made of gold, silver, copper, aluminium, nickel, and the like. The antenna unit 3 may be formed by metal wires, metal foil, electric conductive paste, plating transfer, sputtering, vapor depositions, or screen printing. In the present embodiment 1, the antenna unit 3 is formed by pattern-etching copper foil of the base member 4 in which the copper foil has been formed on both surfaces thereof.

Next, a description is made of the base member 4.

By employing a polyimide substrate, a PET substrate, a glass epoxy substrate, or the like, the base member 4 that has formed thereon the antenna unit 3 may be formed. Since the base member 4 is formed on polyimide, PET, or other substrates, both the antenna unit 3 and the loop pattern 2 may be made thin, and may have flexibility. Also, since cost as to a polyimide film, a PET film, and the like is low, the antenna apparatus 1 may be manufactured in low cost. In the embodiment 1, the base member 4 is made of the polyimide film.

Next, a description is made of the magnetic seat 5.

By employing a metal material such as ferrite, Permalloy, sendust, or a silicone laminated plate, a magnetic member is constructed.

As the magnetic member, soft magnetic ferrite is preferably employed. Since ferrite fine particles are molded by a dry-type pressing method and the molded ferrite is burned, a burned body, a ferrite burned body having high density may be formed. It is preferable that density of soft magnetic ferrite is larger than, or equal to 3.5 g/cm$^3$. Moreover, it is preferable that a dimension of a magnetic member made of the soft magnetic ferrite is larger than, or equal to a crystal grain boundary. Also, the magnetic seat 5 is a sheet-shaped (otherwise, plate-shaped, film-shaped, or layer-shaped) seat that is manufactured by having a thickness from approximately 0.05 mm to 3 mm.

As the soft magnetic ferrite, this magnetic ferrite may be either made of Ni—$ZnO_3$, ZnO, NiO, and CuO or $Fe_2O_3$, ZnO, MnO, and CuO. Moreover, the magnetic member may be made of a single layer of any one magnetic member selected from an amorphous alloy, Permalloy, electromagnetic steel, silicon iron, an Fe—Al alloy, and a sendust alloy. Alternatively, the magnetic member may be made of a stacked layer body constituted by ferrite, amorphous foil, Permalloy, electromagnetic steel, or sendust. Also, another stacked layer body made by stacking various sorts of magnetic members may be alternatively employed as the above-described magnetic member. In the case that magnetic members are stacked on each other, these magnetic members are adhered to each other by employing at least one means selected from a resin, a ultraviolet-setting resin, a visible light-setting resin, a thermoplastic resin, a thermosetting resin, a heat resisting resin, synthetic rubber, a pressure sensitive adhesive double coated tape, an adhesive layer, and a film, so that the resulting magnetic member constitutes a stacked layer structure.

In addition, the magnetic seat 5 of the embodiment 1 of the present invention may be alternatively formed by coating either a single body or a stacked layer body, which is made of materials selected from ferrite, an amorphous alloy, Permalloy, electromagnetic steel, silicon iron, an Fe—Al alloy, and a sendust alloy, by employing at least one means selected from a resin, a ultraviolet-setting resin, a visible light-setting resin, a thermoplastic resin, a thermosetting resin, a heat resisting resin, synthetic rubber, a pressure sensitive adhesive double coated tape, an adhesive layer, and a film.

Also, both a single body and a stacked layer body may be formed by bulk materials of magnetic member solid pieces, while the single body and the stacked layer body are manufactured from ferrite, amorphous foil, Permalloy, electromagnetic steel, or sendust. Since the single body and the stacked layer body are matched with each other to be arranged, the magnetic member can be formed in a higher efficiency with respect to a total thickness of the magnetic seat 5.

In addition, since all of the magnetic member solid pieces are arranged in such a manner that upper planes and lower planes of the magnetic member solid pieces are substantially equal to each other, the maximum volume of the magnetic member can be utilized in such ranges as to a thickness dimension, a mechanical strength, and other physical performance, which are required for the magnetic seat 5, and high magnetic performance can be obtained.

While the magnetic seat 5 of the embodiment 1 of the present invention is made of a single layer, a multi-layer structure, or solid pieces, the coating process is carried out thereto by employing at least one means selected from the resin, the ultraviolet-setting resin, the visible light-setting resin, the thermoplastic resin, the thermosetting resin, the heat resisting resin, the synthetic rubber, the pressure sensitive adhesive double coated tape, the adhesive layer, and the film, so that the resulting magnetic seat 5 can have high flexibility and superior durability; a surface resistance of this magnetic seat 5 can be made high; and a circuit can be readily formed on a surface of this magnetic seat 5 by a pattern printing method, or a plating method.

In the embodiment 1, the magnetic seat 5 is manufactured as follows: That is, either Ni—Zn series ferrite or Mn—Zn series ferrite is burned, or sintered at a temperature from 800° C. to 1000° C.; the burned magnetic seat 5 is coated by the protection members 6 and 7 such as a protection tape, or a pressure sensitive adhesive double coated tape; and then, the coated magnetic seat 5 is ground by utilizing a roller 11, and the like in order that the magnetic seat 5 having flexibility is manufactured.

Also, since the magnetic seat 5 coated by the protection members 6 and 7 has very superior flexibility, the coated magnetic seat 5 can be easily stamping-molded by a punching tool. As a result, the magnetic seat 5 has another feature that even if magnetic seats have complex shapes, a large number of these complex-shaped magnetic seats can be processed/molded in low cost.

In addition, as shapes for the magnetic seat 5, the magnetic seat 5 may be formed in a substantially triangle pole, a substantially rectangular pole, a substantially cylindrical pole, a substantially spherical shape, and the like.

Figure 4:
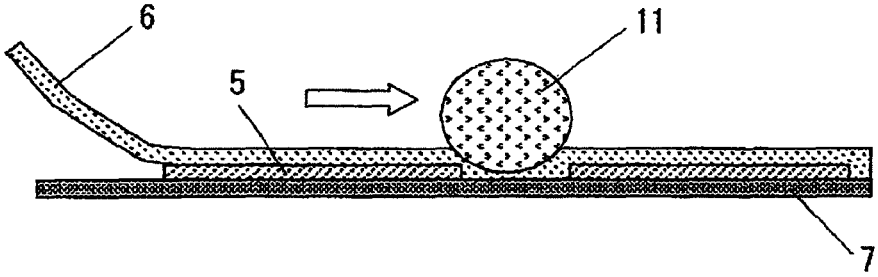
FIG. 4 is a sectional view of the antenna apparatus when a roller is used in the embodiment 1 of the present invention.

As shown in FIG. 4, the magnetic seat 5 of the embodiment 1 of the present invention is fixed on either a pressure sensitive adhesive double coated tape or a very fine adhesive tape etc., and is ground by the roller 11, so that the flexibility may be given to the ground magnetic seat 5. Also, since the magnetic seat 5 is ground by the roller 11, the processing characteristic of the magnetic seat 5 may be improved, and loads when the magnetic seat 5 is processed may be reduced. As a result, low cost of the product may be realized. Moreover, since the magnetic seat 5 is grounded by the roller 11, gaps are produced in the magnetic seat 5. As a result, when a resin is printed on the ground magnetic seat 5, the resin may be penetrated into the ground magnetic seat 5, so that the penetrated resin may play a role of a binder, which may further give the flexibility to the ground magnetic seat 5.

Figure 5:
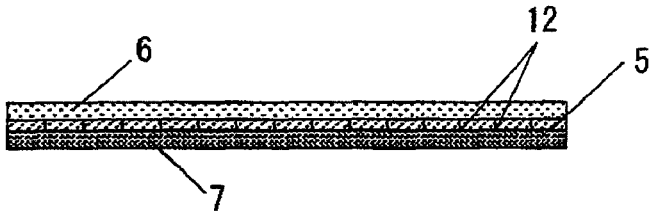
FIG. 5 is a sectional view for representing a magnetic seat provided in the embodiment 1 of the present invention.

Also, as indicated in FIG. 5, with respect to the magnetic seat 5 of the embodiment 1 of the present invention, since slits are formed in a magnetic member, the magnetic seat 5 may be easily divided, so that such a magnetic seat 5 having superior flexibility and superior processing characteristics may be realized.

Next, a description is made of the protection members 6 and 7.

The protection members 6 and 7 may be manufactured by employing at least one means selected from a resin, a ultraviolet-setting resin, a visible light-setting resin, a thermoplastic resin, a thermosetting resin, a heat resisting resin, synthetic rubber, a pressure sensitive adhesive double coated tape, an adhesive layer, and a film, and these means may be alternatively selected by considering not only weather proofing characteristics such as a heat resisting characteristic, a humidity resisting characteristic, and the like, but also the flexibility with respect to bends and flexures of the antenna apparatus 1 and the respective structural components which constructs the antenna apparatus 1. Alternatively, a single plane, both planes, a single side plane, both side planes, or an entire plane of the antenna apparatus 1, and of each of the structural components for constructing the antenna apparatus 1 may be coated by the protection members 6 and 7.

More specifically, normally, the sintered body of the magnetic seat 5 may be destroyed with respect to bends, flexures, and the like. To the contrary, if a single plane, both planes, a single side plane, both side planes or an entire plane of the sintered body of the magnetic seat 5 is coated by the protection members 5 and 6 which are made from the resin, the ultraviolet-setting resin, the visible light-setting resin, the thermoplastic resin, the thermosetting resin, the heat resisting resin, the synthetic rubber, the pressure sensitive adhesive double coated tape, the adhesive layer, or the film, then the protection-coated magnetic seat 5 can have high flexibility; a surface resistance of the protection-coated magnetic seat 5 can be made high; and a circuit can be readily formed on a surface of this magnetic seat 5 by a pattern printing method, or a plating method.

Also, since the magnetic seat 5 coated by the protection members 6 and 7 has the proper flexibility, the coated magnetic seat 5 can be easily stamping-molded by a punching tool. As a result, the magnetic seat 5 has another feature that even if magnetic seats have complex shapes, a large number of these complex-shaped magnetic seats can be processed/molded in low cost.

In such a case that a spacer is employed between the base member 4 and the magnetic seat 5, both the planes of the magnetic seat 5 are no longer coated by the protection member, but only a single plane thereof is coated.

Next, a description is made of a terminal connecting unit 8.

As represented in FIG. 1, the terminal connecting unit 8 has been formed outside the antenna portion 3, and are connected to both end portions of the antenna unit 3. Alternatively, the terminal connecting unit 8 may be formed on the base member 4 where the antenna unit 3 has been formed, and this terminal connecting unit 8 may be connected to a connector (not shown) on a circuit board of a portable telephone.

Also, as materials of the terminal connecting unit 8, any proper materials may be selected from metal wire materials, metal plate materials, metal foil materials, or metal tube materials, which have electric conductive characteristics and are made of gold, silver, copper, aluminium, nickel and the like. The terminal connecting unit 8 may be formed by metal wires, metal foil, electric conductive paste, plating transfer, sputtering, vapor depositions, or screen printing. In the embodiment 1, the terminal connecting unit 8 has been formed on the same base member as to the base member 4, and has been connected to the antenna unit 3 via a through hole (not shown).

The antenna apparatus 1 is manufactured with employment of the above-described structures.

When the antenna apparatus 1 is mounted on a compact terminal such as a portable telephone, since a pressure sensitive adhesive double coated tape, an adhesive agent, or a resin is coated on the base member 4 where both the antenna unit 3 and the loop pattern 2 have been formed in order to adhere the antenna apparatus 1 onto a necessary portion of the portable terminal.

It should also be noted that in the antenna apparatus 1 according to the embodiment 1 of the present invention, while a plurality of loop patterns 2 have been formed on the base member 4, the plural loop patterns 2 are constituted by employing the loop pattern 2 whose one edge is 1.5 mm, the loop pattern 2 whose one edge is 2.0 mm, the loop pattern 2 whose one edge is 5.0 mm, and the loop pattern 2 whose one edge is 7.0 mm.

Also, as to an entire dimension of the antenna apparatus 1, a long edge thereof is 40 mm, a short edge thereof is 30 mm, and gaps among patterns of the antenna unit 3 have been set to 2 mm to 3 mm.

In the case that a resonant frequency of the antenna apparatus 1 is adjusted, since currents flowing through the loop patterns 2 may flow through such loops having short edges whose resistance values are small, trimming portions 13 are successively cut by utilizing a stamping jig in this order from such loop patterns, the lengths of one edges of which are short, in order to change magnetic fields of the loop patterns 2, so that the resonant frequency of the antenna apparatus 1 may be adjusted.

It should also be understood that in the embodiment 1, the punching operation has been carried out, while the dimensions of the punched portions are selected to be 0.5 mm to 1 mm.

It should also be noted that even when the trimming portions 13 are not cut, the loop patterns 2 can be alternatively cut at other positions.

As a consequence, the resonant frequency of the antenna apparatus 1 can be adjusted to the predetermined numeral value, and therefore, the occurrences of the adjusting failures as to the resonant frequencies of the antenna apparatus 1 when the antenna apparatus 1 is assembled can be largely improved.

Also, in accordance with the above-described adjusting method, the loop patterns 2 are cut not at the designing stage, but after the antenna apparatus 1 has been formed, so that the resonant frequencies of the antenna apparatus 2 can be adjusted. As a result, such a frequency shift can be adjusted which cannot be considered at the designing stage during which since the magnetic seat 5 is adhered, the resonant frequency of the antenna apparatus 1 is shifted.

It should also be noted that as to trimming methods of the loop patterns 2, such a method capable of cutting the loop patterns 2 by utilizing an etching process and the like may be alternatively employed in addition to the above-described trimming method by employing the punching jig.

Figure 6:
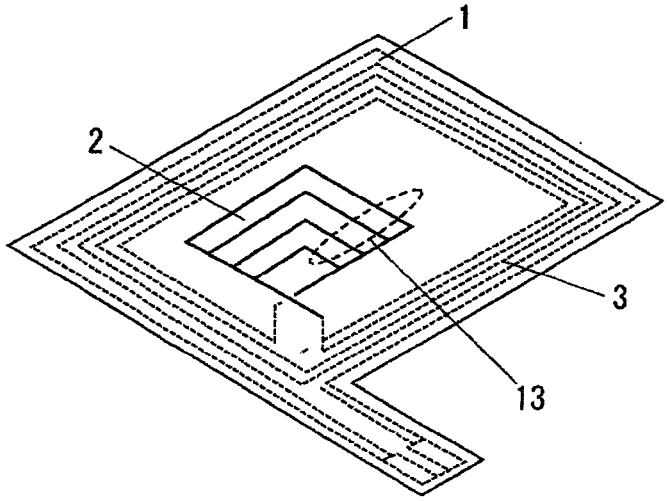
FIG. 6 is a perspective view for indicating an antenna apparatus having a hierarchical layer according to the embodiment 1 of the present invention.

Furthermore, the loop pattern 2 and the antenna unit 3 may not be provided on the same plane. That is, as shown in FIG. 6, in such a case that the loop pattern 2 is located at a plane higher than the antenna unit 3, when the loop pattern 2 is trimmed, since the antenna unit 3 is located at the separate plane, an adverse influence caused by the trimming process may be reduced.

It should be understood that in this embodiment 1, the loop patterns 2 has been cut in order to adjust the resonant frequency. Alternatively, while only the outermost circumferential loop of the loop patterns 2 may be connected at first, the inner circumferential loops may be connected to the outermost circumferential loop by a conductor when the resonant frequency is adjusted.

Embodiment 2

An antenna apparatus 1 according to an embodiment 2 of the present invention is featured by that a large-sized loop pattern 2 and a small-sized loop pattern 2 are provided so as to adjust a resonant frequency thereof. It should be noted that structural elements of the antenna apparatus 1 according to the embodiment 2 similar to those of the above-described embodiment 1 will be denoted by the same reference numerals shown in the embodiment 1.

The antenna apparatus 1 of the embodiment 2 of the present invention has been constructed by employing a base member 4, an antenna unit 3, large-sized and small-sized loop patterns 2, a magnetic seat 5, protection members 6 and 7, and a terminal connecting unit 8.

Figure 7:
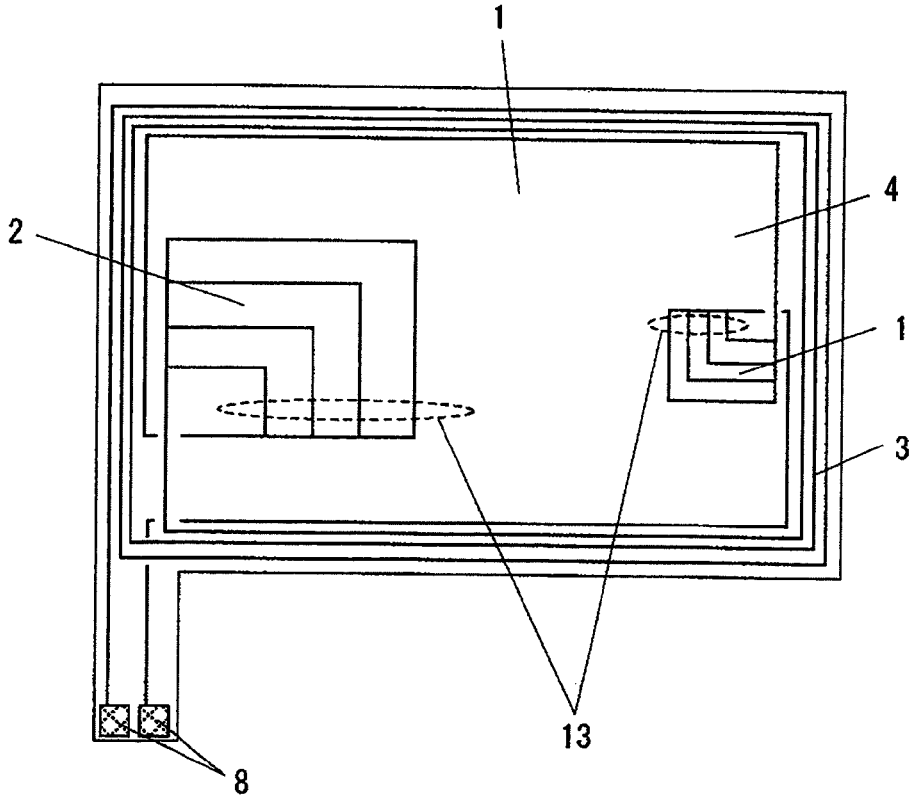
FIG. 7 is an upper view for indicating an antenna apparatus according to an embodiment 2 of the present invention.

The base member 4 has been made of a polyimide substrate. As shown in FIG. 7, while both the antenna unit 3, and the large-sized and small-sized loop patterns 2 have been provided on the base member 4, the large-sized and small-sized loop patterns 2 have been formed at a center portion of a left side plane of the antenna unit 2 and a center portion of a right side plane thereof, respectively. As to the antenna unit 3 and the loop patterns 2, a polyimide substrate where copper foil has been coated on both side planes thereof is pattern-etched, and either a coverage or a cover resist is formed on this pattern-etched substrate so as to form the base member 4.

The terminal connecting unit 8 has been formed on the same substrate as to the base member 4, and has been connected to the antenna unit 3 via a through hole (not shown).

On the other hand, the magnetic seat 5 is manufactured as follows: That is, either Ni—Zn series ferrite or Mn—Zn series ferrite is burned, or sintered at a temperature from 800° C. to 1000° C.; the burned magnetic seat 5 is coated by the protection members 6 and 7 such as a protection tape, or a pressure sensitive adhesive double coated tape; and then, the coated magnetic seat 5 is ground by utilizing a roller 11, and the like in order that the magnetic seat 5 having flexibility is manufactured.

After the magnetic seat 5 has been adhered to the base member 4 by utilizing the pressure sensitive adhesive double coated tape, two sets of the large-sized and small-sized loop patterns 2 are trimmed by employing a stamping jig so as to adjust a resonant frequency of the antenna apparatus 1.

The antenna apparatus 1 is accomplished by executing such manufacturing steps.

Also, when the antenna apparatus 1 is mounted on a compact terminal such as a mobile phone, since a pressure sensitive adhesive double coated tape, an adhesive agent, or a resin is coated on the base member 4 where both the antenna unit 3 and the large-sized and small-sized loop patterns 2 have been formed in order to adhere the antenna apparatus 1 onto a necessary portion of the portable terminal.

It should also be noted that in the antenna apparatus 1 according to the embodiment 2 of the present invention, while two sets of the large-sized and small-sized loop patterns 2 have been formed on the base member 4, the resonant frequencies of the antenna apparatus 1 are adjusted in such a manner that when the resonant frequencies of the antenna apparatus 1 are wanted to be moved by −200 KHz, the large-sized loop pattern 2 is trimmed, whereas when the resonant frequencies of the antenna apparatus 1 are wanted to be moved by −50 KHz, the small-sized loop pattern 2 is trimmed.

As a consequence, the resonant frequencies of the antenna apparatus 1 can be adjusted to the predetermined numeral value, and therefore, the occurrences of the adjusting failures as to the resonant frequencies of the antenna apparatus 1 when the antenna apparatus 1 is assembled can be largely improved. Furthermore, the narrow tolerance with respect to the center frequency can be satisfied, which is required from the manufactures of the mobile phones.

Page 9

It should also be noted that although 2 sets of the large-sized and small-sized loop antennas 2 have been in the above-described embodiment 2, if 3, or more sets of loop patterns 2 are formed, then the resonant frequencies may be adjusted in a finer manner.

Embodiment 3

An antenna apparatus 1 according to an embodiment 3 of the present invention is featured by that a loop pattern 2 and a ladder-shaped pattern 9 are combined with each other so as to adjust a resonant frequency thereof. It should be noted that structural elements of the antenna apparatus 1 according to the embodiment 3 similar to those of the above-described embodiment 1 will be denoted by the same reference numerals shown in the embodiment 1.

The antenna apparatus 1 of the embodiment 3 of the present invention has been constructed by employing a base member 4, an antenna unit 3, the loop pattern 2, the ladder-shaped pattern 9, a magnetic seat 5, protection members 6 and 7, and a terminal connecting unit 8.

Figure 8:
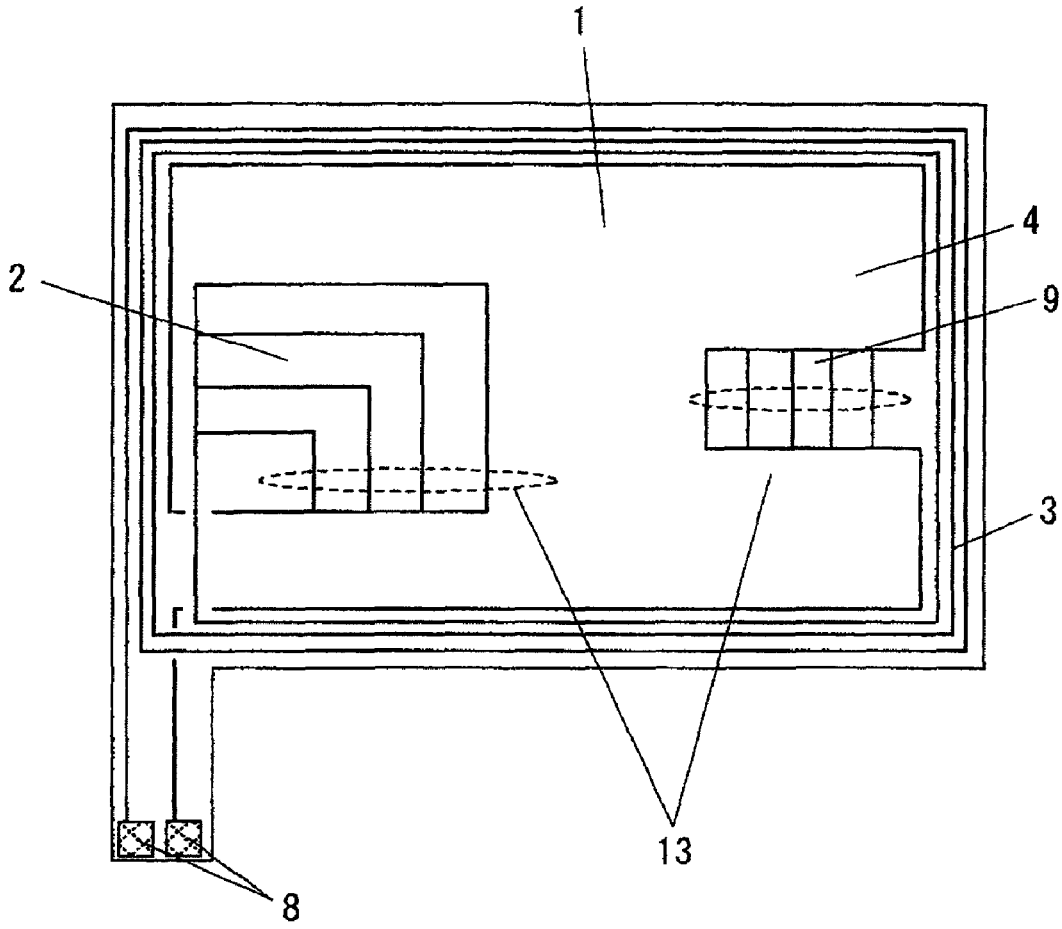
FIG. 8 is an upper view for indicating an antenna apparatus according to an embodiment 3 of the present invention.

The base member 4 has been made of a polyimide substrate. As shown in FIG. 8, while both the antenna unit 3, the loop pattern 2, and the ladder-shaped pattern 9 have been provided on the base member 4, the loop pattern 2 has been formed at a center portion of a left side plane of the antenna unit 2 and the ladder-shaped pattern 9 has been formed at a center portion of a right side plane thereof, respectively. As to the antenna unit 3, the loop pattern 2, and the ladder-shaped pattern 9, a polyimide substrate where copper foil has been coated on both side planes thereof is pattern-etched, and either a coverage or a cover resist is formed on this pattern-etched substrate so as to form the base member 4.

The terminal connecting unit 8 has been formed on the same substrate as to the base member 4, and has been connected to the antenna unit 3 via a through hole (not shown).

On the other hand, the magnetic seat 5 is manufactured as follows: That is, either Ni—Zn series ferrite or Mn—Zn series ferrite is burned, or sintered at a temperature from 800° C. to 1000° C.; the burned magnetic seat 5 is coated by the protection members 6 and 7 such as a protection tape, or a pressure sensitive adhesive double coated tape; and then, the coated magnetic seat 5 is ground by utilizing a roller 11, and the like in order that the magnetic seat 5 having flexibility is manufactured.

After the magnetic seat 5 has been adhered to the base member 4 by utilizing the pressure sensitive adhesive double coated tape, the loop patterns 2 and the ladder-shaped pattern 9 are trimmed by employing a stamping jig so as to adjust a resonant frequency of the antenna apparatus 1.

The antenna apparatus 1 is accomplished by executing such manufacturing steps.

Also, when the antenna apparatus 1 is mounted on a compact terminal such as a mobile phone, since a pressure sensitive adhesive double coated tape, an adhesive agent, or a resin is coated on the base member 4 where both the antenna unit 3 and the pattern 2 have been formed in order to adhere the antenna apparatus 1 onto a necessary portion of the portable terminal.

It should also be noted that in the antenna apparatus 1 according to the embodiment 3 of the present invention, while the ladder-shaped pattern 9 and the loop pattern 2 have been formed on an antenna board, the resonant frequencies of the antenna apparatus 1 are adjusted in such a manner that when the resonant frequencies of the antenna apparatus 1 are wanted to be moved by −200 KHz, the loop pattern 2 is trimmed, whereas when the resonant frequencies of the antenna apparatus 1 are wanted to be moved by −50 KHz, the ladder-shaped pattern 2 is trimmed.

As a consequence, the resonant frequencies of the antenna apparatus 1 can be adjusted to the predetermined numeral value, and therefore, the occurrences of the adjusting failures as to the resonant frequencies of the antenna apparatus 1 when the antenna apparatus 1 is assembled can be largely improved. Furthermore, the narrow tolerance with respect to the center frequency can be satisfied, which is required from the manufactures of the mobile phones.

Embodiment 4

An antenna apparatus 1 according to an embodiment 4 of the present invention is featured by that a loop portion 2 is combined with a capacitance pattern of a capacitor so as to adjust a resonant frequency thereof. It should be noted that structural elements of the antenna apparatus 1 according to the embodiment 4 similar to those of the above-described embodiment 1 will be denoted by the same reference numerals shown in the embodiment 1.

The antenna apparatus 1 of the embodiment 4 of the present invention has been constructed by employing a base member 4, an antenna unit 3, the loop pattern 2, the capacitor capacitance pattern 10, a magnetic seat 5, protection members 6 and 7, and a terminal connecting unit 8.

Figure 9:
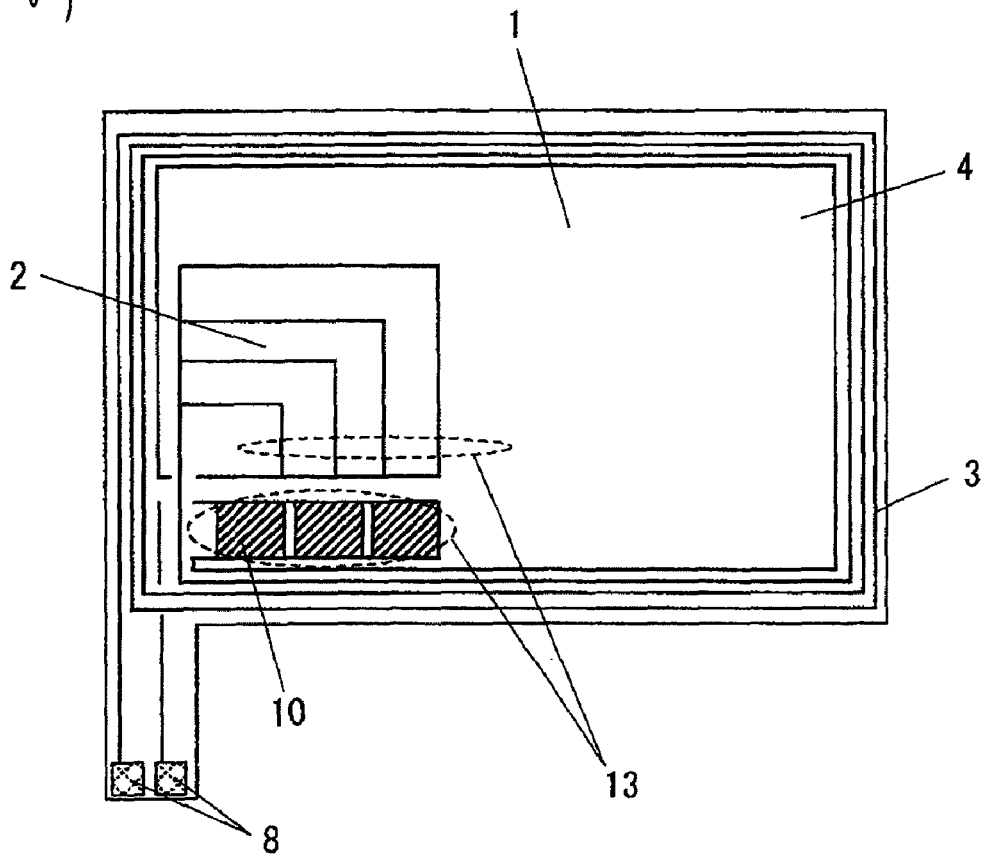
FIG. 9 is an upper view for indicating an antenna apparatus according to an embodiment 4 of the present invention.
Figure 10:
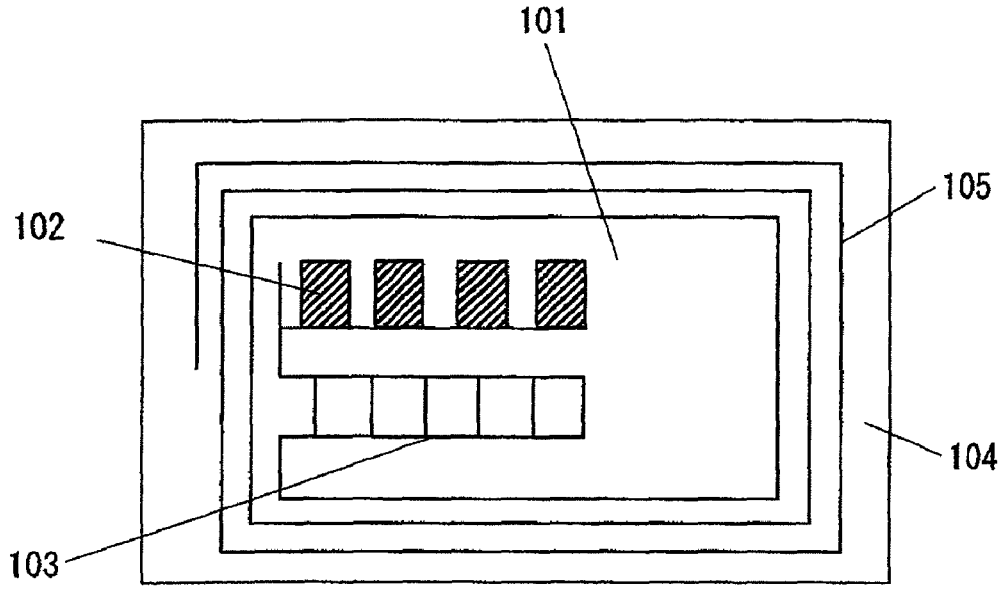
Fig. 10 Prior Art
FIG. 10 is the upper view for showing the antenna apparatus of the conventional technique.

The base member 4 has been made of a polyimide substrate. As shown in FIG. 9, while the antenna unit 3, the capacitor capacitance pattern 10, and the loop pattern 2 have been provided on the base member 4, the loop pattern 2 has been formed at a center portion of a left side plane of the antenna unit 2, and also, the capacitor capacitance pattern 10 has been formed between the antenna unit 3 and the terminal connecting unit 8. As to the antenna unit 3, the loop pattern 2, and the capacitor capacitance pattern 10, a polyimide substrate where copper foil has been coated on both side planes thereof is pattern-etched, and either a coverage or a cover resist is formed on this pattern-etched substrate so as to form an antenna board.

The terminal connecting unit 8 has been formed on the same substrate as to the base member 4, and has been connected to the antenna unit 3 via a through hole (not shown).

On the other hand, the magnetic seat 5 is manufactured as follows: That is, either Ni—Zn series ferrite or Mn—Zn series ferrite is burned, or sintered at a temperature from 800° C. to 1000° C.; the burned magnetic seat 5 is coated by the protection members 6 and 7 such as a protection tape, or a pressure sensitive adhesive double coated tape; and then, the coated magnetic seat 5 is ground by utilizing a roller 11, and the like in order that the magnetic seat 5 having flexibility is manufactured.

After the magnetic seat 5 has been adhered to the base member 4 by utilizing the pressure sensitive adhesive double coated tape, the capacitor capacitance pattern 10 and the loop pattern 2 are trimmed by employing a stamping jig so as to adjust a resonant frequency of the antenna apparatus 1.

The antenna apparatus 1 is accomplished by executing such manufacturing steps.

Also, when the antenna apparatus 1 is mounted on a compact terminal such as a mobile phone, since a pressure sensitive adhesive double coated tape, an adhesive agent, or a resin is coated on the base member 4 where both the antenna unit 3 and the loop pattern 2 have been formed in order to adhere the antenna apparatus 1 onto a necessary portion of the portable terminal.

It should also be noted that in the antenna apparatus 1 according to the embodiment 4 of the present invention, while the capacitor capacitance pattern 10 and the pattern 2 have been formed on the base member 4, the resonant frequencies of the antenna apparatus 1 are adjusted in such a manner that when the resonant frequencies of the antenna apparatus 1 are wanted to be moved by −200 KHz, the loop pattern 2 is trimmed, whereas when the resonant frequencies of the antenna apparatus 1 are wanted to be moved by −50 KHz, the capacitor capacitance pattern 10 is trimmed.

As a consequence, the resonant frequencies of the antenna apparatus 1 can be adjusted to the predetermined numeral value, and therefore, the occurrences of the adjusting failures as to the resonant frequencies of the antenna apparatus 1 when the antenna apparatus 1 is assembled can be largely improved. Furthermore, the narrow tolerance with respect to the center frequency can be satisfied, which is required from the manufactures of the mobile phones.

The present invention is directed to such a wireless communication media processing apparatus which supplies both electric power and transmission data to such wireless communication media as non-contact IC cards and IC tags, which are stored in merchandise racks and the like, and also, the wireless communication media processing apparatus acquires reception data from the wireless communication media due to variations in loads. More specifically, the wireless communication media processing apparatus of the present invention can also be applied to fields such as medicine managing systems, dangerous product managing systems, valuable article managing systems other than storage racks capable of automatically managing merchandise and books, in which communication ranges thereof are required to be expanded.

Also, the present invention may be usefully applied to application fields such as mobile phones, televisions, and personal computers.

This application is based upon and claims the benefit of priority of Japanese Patent Application No 2008-000911 filed on Jan. 8, 2008, the contents of which is incorporated herein by references in its entirety.

What is claimed is:

1. An antenna apparatus, comprising:

a first loop pattern, provided within an antenna board; and a second loop pattern, provided within the antenna board and being wound such that a magnetic field is generated from the second loop pattern along the same direction as that of the first loop antenna, the second loop pattern being formed by a plurality of loops connected parallel to each other, wherein the second loop pattern is eccentrically located with respect to the first loop pattern.

2. The antenna apparatus as claimed in claim 1, wherein at least a smallest loop among the second loop pattern is cut off.

3. The antenna apparatus as claimed in claim 1, further comprising:

a third loop pattern within the antenna board, which is smaller than the second loop pattern.

4. The antenna apparatus as claimed in claim 1, further comprising:

a ladder-shaped pattern within the antenna board.

5. The antenna apparatus as claimed in claim 1, further comprising:

a capacitor capacitance pattern within the antenna board.

6. The antenna apparatus as claimed in claim 1, wherein a ferrite seat is adhered to an entire plane of a lower side of the antenna board.

7. The antenna apparatus as claimed in claim 1, wherein a ferrite seat is not formed under the second loop pattern that is formed within the antenna board.

8. A method of adjusting an antenna apparatus, in which a first loop pattern and a second loop pattern that are provided within an antenna board; the second loop pattern has a plurality of loops connected parallel to each other and is wound such that a magnetic field of the second loop pattern is generated along the same direction as that of the first loop pattern;

wherein a resonant frequency of the antenna apparatus is adjusted by sequentially cutting off the plurality of loops of the second loop pattern in an order from the smallest loop.

9. A mobile cell phone, comprising the antenna apparatus of claim 1.

* * * * *

UNITED STATES PATENT AND TRADEMARK OFFICE

CERTIFICATE OF CORRECTION

PATENT NO. : 7,990,326 B2
APPLICATION NO. : 12/349536
DATED : August 2, 2011
INVENTOR(S) : Nakamura et al.

It is certified that error appears in the above-identified patent and that said Letters Patent is hereby corrected as shown below:

At column 12, line 52 (claim 8, line 2) of the printed patent, please delete "that" after pattern.

Signed and Sealed this
Sixth Day of March, 2012

David J. Kappos

David J. Kappos
*Director of the United States Patent and Trademark Office*